US006098311A

United States Patent [19]

Henry

[11] Patent Number: 6,098,311

[45] Date of Patent: Aug. 8, 2000

[54] AIR HEATING AND CONTROL SYSTEM

[75] Inventor: Lee L. Henry, San Jose, Calif.

[73] Assignee: Impact Systems, Inc., Los Gatos, Calif.

[21] Appl. No.: 09/160,200

[22] Filed: Sep. 16, 1998

[51] Int. Cl.[7] ..... F26B 19/00

[52] U.S. Cl. ..... 34/552; 34/553; 34/117; 34/119; 34/124; 100/38; 219/483

[58] Field of Search ..... 34/524, 549, 552, 34/553, 111, 114, 117, 119, 120, 122, 124; 219/483, 486, 497, 499, 505; 100/38, 92, 308, 309

[56] References Cited

U.S. PATENT DOCUMENTS

| | | | |
|---|---|---|---|
| 3,789,190 | 1/1974 | Orosy et al. | 219/497 |
| 4,573,402 | 3/1986 | Sharma et al. | 100/38 |
| 4,675,509 | 6/1987 | Hell | 219/486 |
| 5,340,964 | 8/1994 | Galloway et al. | 219/486 |

*Primary Examiner*—Pamela A. Wilson
*Attorney, Agent, or Firm*—Jerry G. Wright; Flehr Hohbach Test Albritton & Herbert LLP

[57] ABSTRACT

An air heating and control system, which in one application controls the diameter of a calender roll in the paper making process, includes a row of heater packs proximate to the various zones of the calender roll. Each heater pack has a plurality of electrical heating coils which are at least partially connected in parallel so that failure of one coil does not interrupt power to the remaining coils. Air flowing through the heating coils is heated to a desired temperature and impinges upon the calender roll to expand it as desired. A control system senses a defective coil, which effectively reduces current in a heater pack, and increases the voltage imposed upon that heater pack to again produce the desired power level or heating effect. Thus failure of a heating coil is immediately compensated for.

4 Claims, 3 Drawing Sheets

AIR HEATING AND CONTROL SYSTEM

The present invention is directed to air heating an control system and specifically to a system for treating a web of material such as paper being manufactured in a paper making process, by a row of heater packs arranged in an axial direction proximate to a rotating roll such as a calender roll.

BACKGROUND OF THE INVENTION

U.S. Pat. No. 4,573,402, assigned to the assignee of the present invention, discloses a system for treating a web of material such as paper by selectively treating the surface of a rotating calender roll. Heater packs are arranged in a row axially along and in proximity to the calender roll, and by controlling the power level to the heater pack in each zone, the calender roll is selectively heated.

Each heater pack is composed of two or more heating coils. In a preferred embodiment of the patent, the heater pack has two heating elements or coils mounted side by side and connected electrically in series.

Commercial modifications of the foregoing include as many as twelve coils in a single heater pack which can provide an output power level or heating effect of six kilowatts. These multiple coil packs also have been connected in series. A failure of one of the coils in the heater pack, of course, would cause the entire pack to fail and affect that proximate zone or portion of the web material or paper being manufactured. It would also necessitate an immediate replacement. Adjacent heater packs could have their power output or level raised to compensate but this is generally not satisfactory.

OBJECT AND SUMMARY OF THE INVENTION

It is an object of the present invention to provide an improved air heating and control system having a row of heater packs proximate to the zones of a paper making process, each pack having a plurality of electrical heating coils, arranged next to each other in an axial direction proximate to a rotating roll of the paper making process. Each pack has a desired power level for heating the air flowing therethrough for a specific zone. The electrical heating coils are physically arranged parallel to one another in close proximity to form a heater pack. Such heating and control system comprises a controllable power source having a pair of output terminals for each zone. The coils of a pack are electrically connected at least partially in parallel to provide a pair of heater pack terminals which are connected to the pair of output terminals and to provide for continuance of power to the remaining coils if one fails. A control system includes current sensing means for sensing the magnitude of current to each heater pack, means for comparing the sensed magnitude with a predetermined desired power level, and means for increasing the voltage at the output terminals if the sensed magnitude is less than the predetermined desired power level to produce the desired power level.

DETAILED DESCRIPTION OF PREFERRED EMBODIMENT

Figure 1:
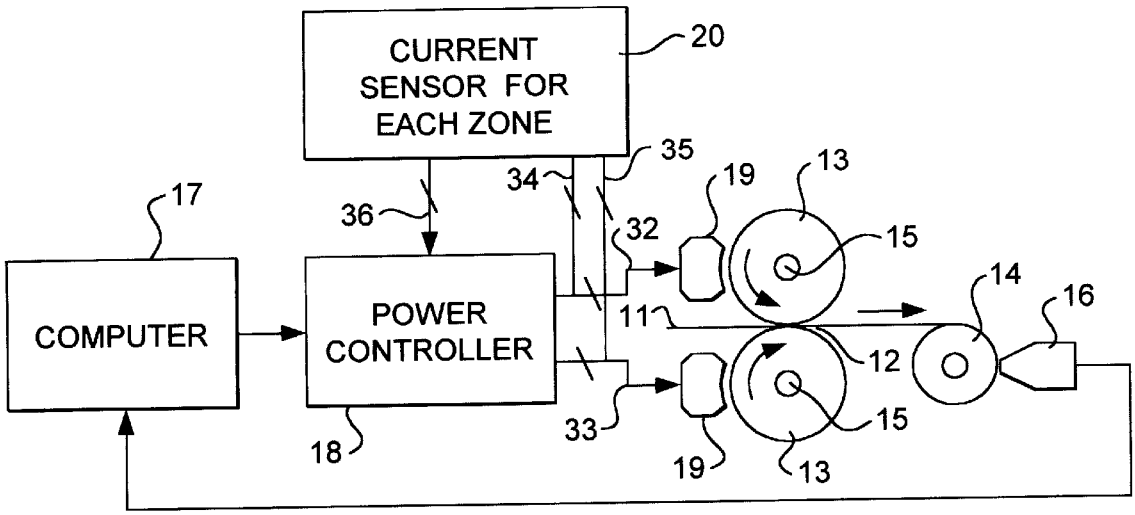
FIG. 1 is a schematic drawing of a heating and control system embodying the present invention.

In the manufacture of paper, caliper is of primary importance. Because of its effect on reel hardness and reel building, a calender stack has traditionally been used to make adjustments to the cross direction caliper. Such adjustments are made by applying or removing heat at selected locations (more commonly termed zones) across the calender roll to cause local variations in its diameter. The above '402 patent discloses such a technique which is also illustrated in FIG. 1. The web of paper 11 passes through a nip 12 formed between two calender rolls 13 rotating on their axes 15. Passing between the calender rolls, the paper is rolled to form a reel 14. Sensors 16 monitor the hardness and uniformity of the reel during the reel building process. A feedback control signal representative of the above parameters is applied to a computer 17 which acts on the power controller 18 to control the operation of the actuators 19. These control the temperature of air which exits the actuators and impinges upon the calender rolls 13 and thus controls the diameter of the calender rolls 13 in each zone.

Figure 2:
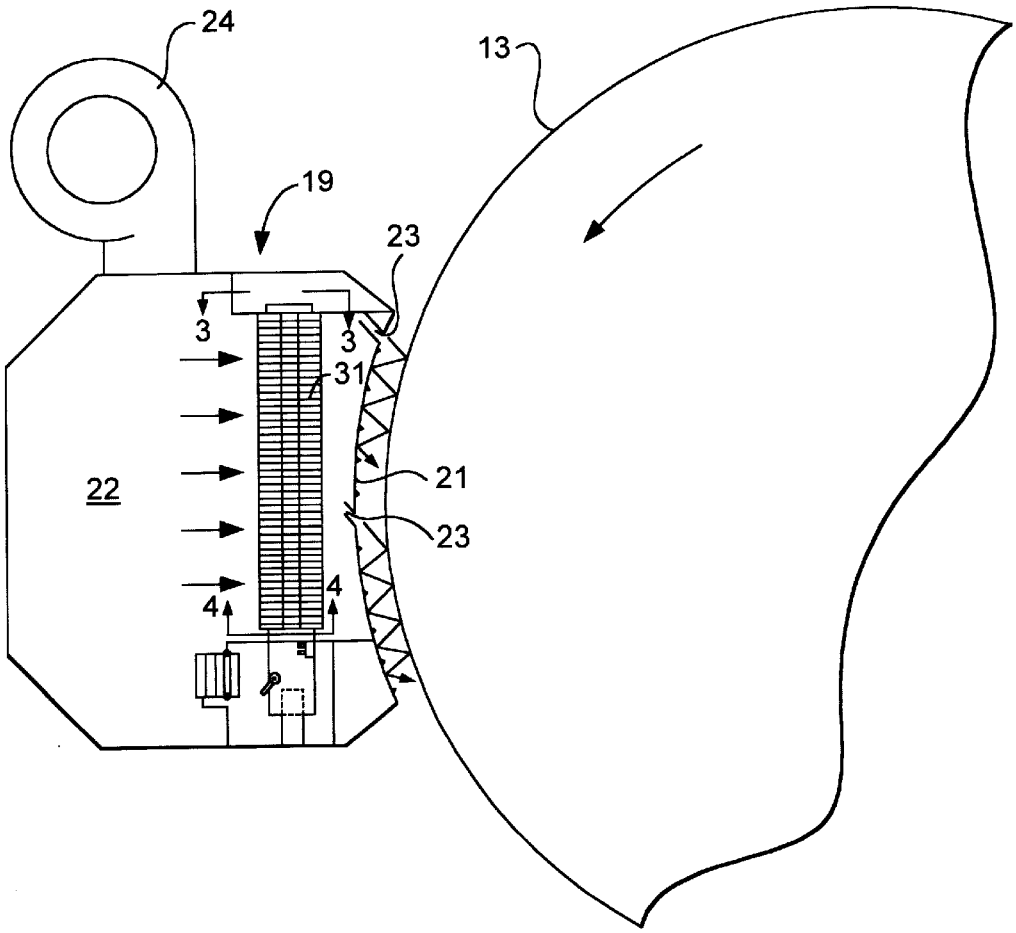
FIG. 2 is an enlarged cross-sectional view somewhat schematic of a portion of FIG. 1.

FIG. 2 illustrates one of the actuators 19 which comprises an axially elongated cylindrically curved faceplate 21 having a concave front surface which faces the calender roll 13. The faceplate 21 includes several discharge openings 23, only two of which have been illustrated. Heated air at a high velocity is discharged in a region between the faceplate 23 and roll 13. Plenum chamber 22 is formed in conjunction with faceplate 23 and a vertically positioned heater pack 31 mounted in it and behind and in close proximity to faceplate 21. In actual practice a row of heater packs proximate to the zones of the calender roll 13 are arranged next to each other in the axial direction of the axis 15 of calender roll 13 to extend along the entire cross direction or width of the moving paper 11.

Pressurized air is introduced into the plenum 22 by a blower 24 and air flows through heater pack 31 and is heated to a predetermined temperature by use of a desired power level. The heater pack 31 functions to control the diameter of calender roll 13 for that particular zone.

Referring back to FIG. 1, each heater pack 31 is powered by voltage on a corresponding pair of wires contained in the cables 32 and 33 from power controller 18. The power controller 18 has a pair of output terminals for each zone. The magnitude of the current for each zone is sensed by the current transformer connectors 34 and 35 from unit 20, and then this magnitude information is communicated via cable 36 to power controller 18 for the control processing as will be described below.

Figure 3:
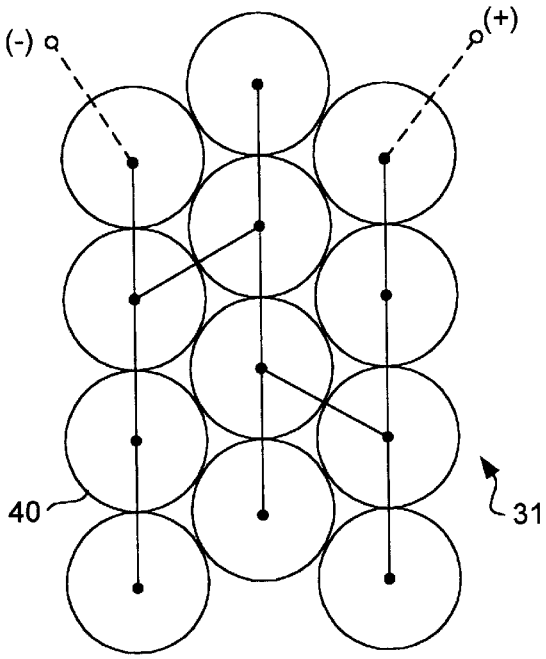
FIG. 3 is a simplified cross-sectional view taken along the line 3—3 of FIG. 2.
Figure 4:
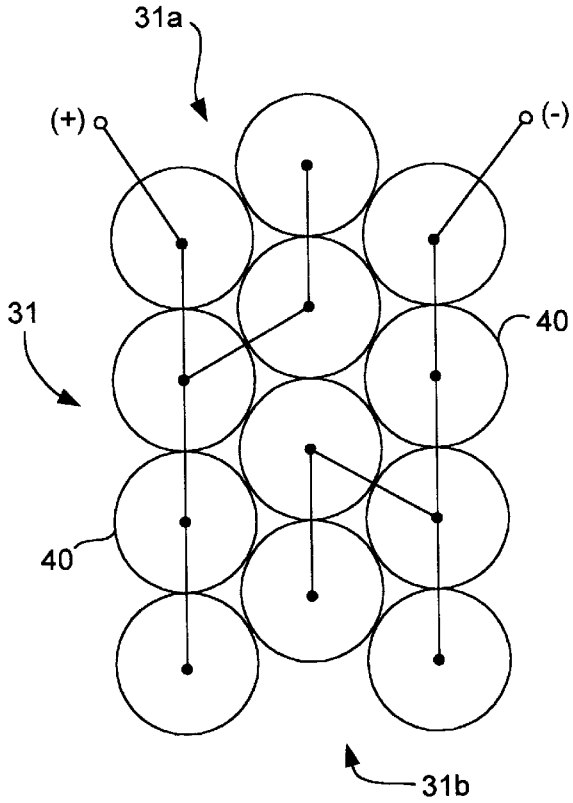
FIG. 4 is a simplified cross-sectional view taken along the line 4—4 of FIG. 2.

FIGS. 3 and 4 show views of the two ends of a typical heater pack 31. The end illustrated in FIG. 4 has two terminals labeled positive and negative for convenience. Each heater pack 31 is composed of, in one embodiment of the invention, twelve individual electrical heating coils 40 arranged physically parallel to one another in close proximity to form the heater pack as clearly illustrated in FIGS. 3 and 4. Other combinations of individual coils such as four or eight coils may also readily be used. The terminals of each heater pack are connected to unique output terminals of power controller 18. All of these connections are in cables 32 and 33 as illustrated in FIG. 1. By application of a controllable voltage to the resistive heating coils 40, a desired amount of heating or the required power level, may be produced.

Still referring to FIGS. 3 and 4, the individual coils 40 of the heater packs 31 are at least partially electrically connected in parallel. Specifically, as shown in FIG. 3, at one end of the heater pack 31 all of the terminals of the coils are connected together. At the other end, as shown in FIG. 4, one half 31*a* and the other half 31*b* of the coils of the heater pack are each connected in parallel to form the pair of terminals. In FIG. 3, the positive/negative notation is to show how the view at that end relates to the end view shown in FIG. 4. However there is no actual connection at the end of FIG. 3. Referring briefly to FIG. 2, this allows the circuit connections to be very simplified. Only at the lower end of the heater pack 31 are external circuit connections required.

Figure 5:
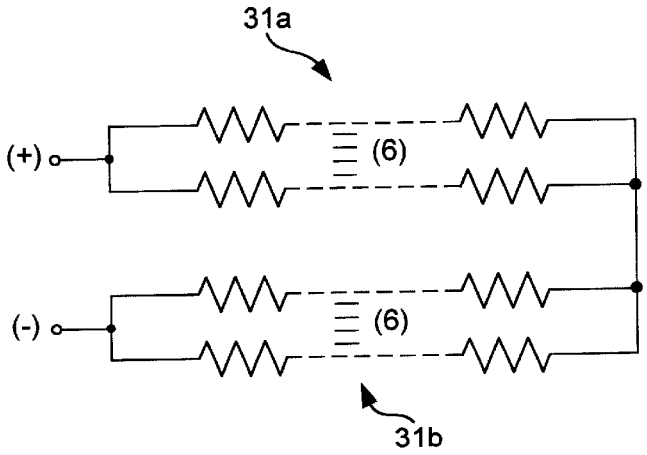
FIG. 5 is a circuit schematic of FIGS. 3 and 4.

FIG. 5 shows the equivalent electrical circuit of FIGS. 3 and 4 where the heater pack halves 31*a* and 31*b* are illustrated. Each has six coils connected in parallel as shown with the two individual halves being connected in series.

In operation, with the at least partially parallel connection shown in FIG. 5, failure of any one coil 40 reduces the power level of the heater pack and thus the air temperature exiting that heater pack. However, such failure is not catastrophic. Because of the parallel connection with at least four heating coils most of the heating effect is retained. (This is to be compared to an all series arrangement). Thus, the at least partial parallel connection provides for the continuance of power to the remainder of the heating coils in that parallel branch if one coil fails and causes an open circuit.

Figure 6:
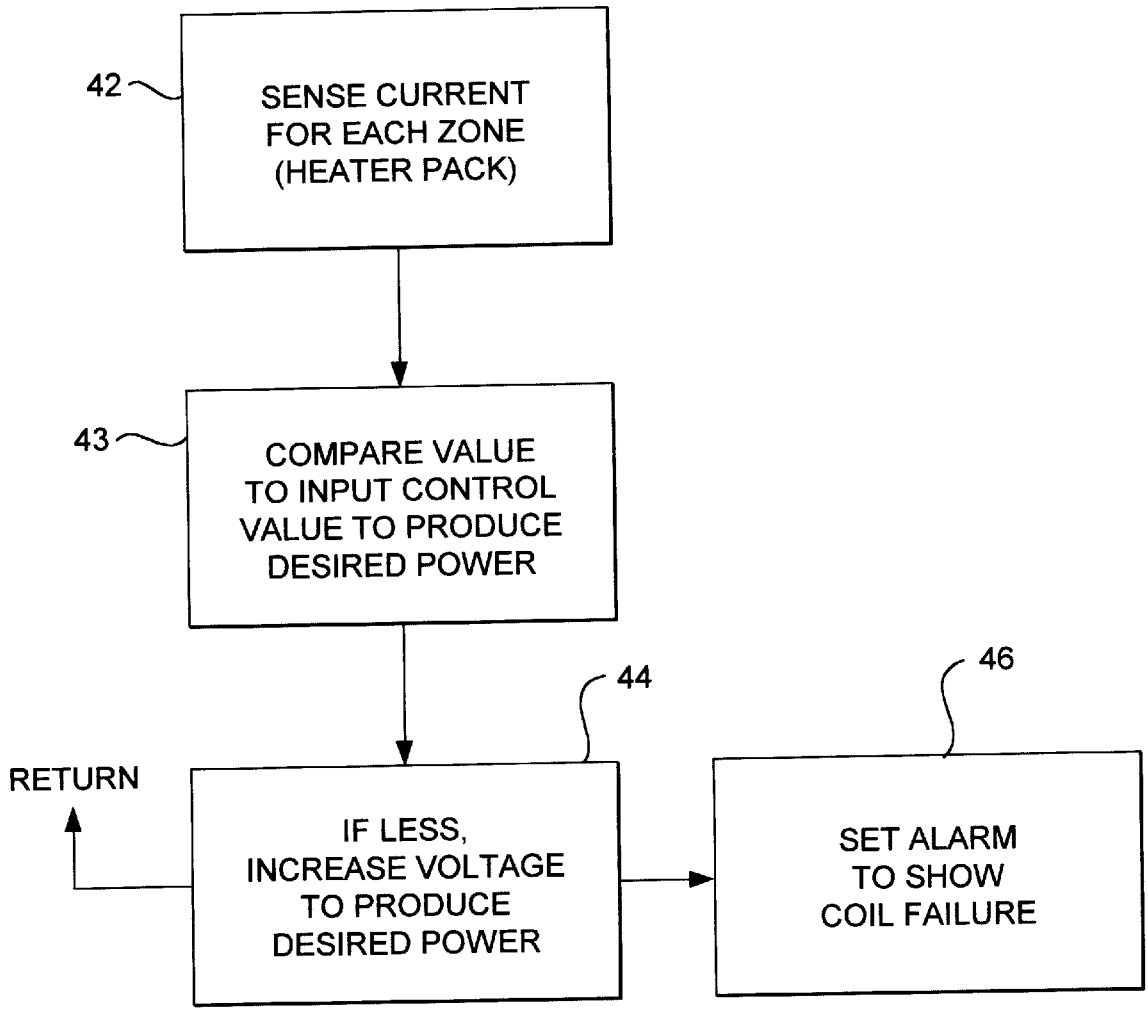
FIG. 6 is a flow chart illustrating the operation of the control system of the present invention.

In order to immediately restore the power level to the desired amount, the effect of a drop in reduction in current due to an elimination of one of the parallel branches is sensed by the current sensor 20 illustrated in FIG. 1. The power controller 18 by use of computer 17 utilizes this information to restore power to the desired level. FIG. 6 shows the flow chart by which the power controller 18 and computer 17 operate. In block 42 the current is sensed for each zone as discussed above. Then in block 43 this value is compared to the needed input control value to produce the desired power. In block 44 if there has been a failure and thus the measured value is less than the control value, voltage to the particular heater pack is increased to again produce the desired power or heating effect. At the same time, as illustrated in block 46, an alarm is set to show coil failure for later replacement. This replacement does not need to be done immediately since the desired power level or heating effect has been maintained. In block 44 there is a RETURN for the next sequence of operation.

Although an even number of individual heating coils 40 has been illustrated, the invention would still operate effectively with an odd number, all that is required is that there are at least four coils (two in each parallel branch) to prevent a catastrophic failure. The invention besides being applicable to the specific calender roll technique shown in FIG. 1, is also applicable to other portions of the paper making or similar processes where it is necessary to control the temperature of a rotating roll; for example, in a super calender stack where gloss is to be controlled, and where the heat transfer to a solid rotating roll must be controlled to control gloss. Here, of course, the cross direction control capability is not as important. However it should be kept in mind that for the immediate correction of coil failure, each heater pack or small groups of packs must have individual circuit connections in order to compensate for coil failure in that pack.

Thus an improved air heating and control system has been provided where in a failure mode a correction is immediately made and the production of defective web material such as paper is almost entirely prevented.

What is claimed is:

1. An air heating and control system having a row of heater packs proximate to the zones of a paper making process, such zones being in a cross-direction perpendicular to the machine direction of the paper being produced, each pack of said heater packs having a plurality of electrical heating coils arranged next to each other in an axial direction proximate to a rotating roll of the paper making process, each pack having a desired power level for heating the air flowing therethrough for a specific zone, said electrical heating coils being arranged physically parallel to one another in close proximity to form a heater pack, comprising:

a controllable power source having only a pair of output terminals for each zone;

means for electrically connecting at least four of said coils of a pack at least partially in parallel to provide a pair of heater pack terminals which are connected to said pair of output terminals and to provide for continuance of power to remaining heating coils if one heating coil fails;

a control system including current sensing means for sensing the magnitude of current to each said heater pack, means for comparing said sensed magnitude with a predetermined desired power level, and means for increasing the voltage at said output terminals if said sensed magnitude is less than said predetermined desired power level to produce the said desired power level.

2. A heating and control system as in claim 1 where said at least four coils of said pack are substantially split in half with the individual coils of each half being connected in parallel and the individual halves being connected in series whereby said pair of terminals is provided one for each half.

3. A heating and control system as in claim 1 including means for setting an alarm if said sensed current magnitude is less than said predetermined desired power level.

4. A heating and control system as in claim 2 where each said heater pack has two ends, all of said coils of said pack being electrically connected at one end of said two ends and said pair of terminals being at the other end of said two ends.

* * * * *